United States Patent [19]

Kushida et al.

[11] Patent Number: 4,876,523

[45] Date of Patent: Oct. 24, 1989

[54] SWITCH FOR CIRCUIT BREAKER

[75] Inventors: Osami Kushida; Hisamitsu Ninomiya; Masakazu Nezuka, all of Gotemba; Yoshihiko Ishikawa, Tokyo, all of Japan

[73] Assignee: Texas Instruments Incorporated, Dallas, Tex.

[21] Appl. No.: 259,641

[22] Filed: Oct. 19, 1988

[30] Foreign Application Priority Data

May 2, 1988 [JP] Japan ..... 63-109735

[51] Int. Cl.[4] ..... H01H 85/04; H01H 37/00

[52] U.S. Cl. ..... 337/299; 337/3; 337/4

[58] Field of Search ..... 337/3, 4, 299; 219/512

[56] References Cited

U.S. PATENT DOCUMENTS 4,295,114 10/1981 Pohl ..... 337/3
4,319,126 3/1982 Lujic ..... 337/299
4,472,705 9/1984 Carlson ..... 337/299

FOREIGN PATENT DOCUMENTS 2611169 9/1977 Fed. Rep. of Germany ..... 337/4

*Primary Examiner*—H. Broome
*Attorney, Agent, or Firm*—John A. Haug; James P. McAndrews; Melvin Sharp

[57] ABSTRACT

A switch is shown having a thermostatic member which deforms in response to variations in temperature to thereby control the state of energization of the switch. The thermostatic member is shown cantilever mounted or centrally mounted using material to affix the member to a support which melts at a selected temperature to cause the member to separate from the support upon the occurrence of selected conditions.

6 Claims, 5 Drawing Sheets

SWITCH FOR CIRCUIT BREAKER

BACKGROUND OF THE INVENTION

1. Field of the Invention

This invention relates in general to a switch device and in particular to a switch device that carries out an opening and closing action in conformity with variations in temperature.

2. Brief Description of the Prior Art

Electrical appliances such as motors generate heat when they are subjected to an overload and if they are continuously used despite such overload the insulating coating of the coil is burnt, thereby demaging the motor and making it impossible for them to function any longer. In order to prevent this it is conventional to use a switch device (protective device) that employs a bimetal which opens a movable contact due to abnormal electric current and abnormal temperature, thereby bringing about the OFF state.

Examples of the above-described switch device are shown in FIGS. 9 through 11.

In the switch device 41 which is shown in FIG. 9, a bimetal disc 7 is fixed to a bolt 5 via a washer 30. This fixing is effected by deforming the head 5*c* of the bolt 5 (or by screwing the same). The bolt 5 is screwed to a female screw 5*b* which extends through a bore in bottom wall 3 of electrically insulative housing 2 and is secured to the bottom wall 3 as it is tightened by means of a lock nut 6. In the insulative housing 2, terminals 13*b* and 14*b* of the fixed contact point 13*a* and 14*a* are fixed as by staking and the insulative housing 2 is covered by an electrically insulative lid 16.

At the time when the motor is in normal operation, the movable contacts 8 and 8 which are mounted on the bimetal disc 7 are in engagement with the stationary contacts 13*a* and 14*a* and the terminals 13B and 14B that protrude under the insulative housing 2 are electrically connected through the stationary contacts 13*a* and 14*a*, movable contacts 8 and 8 and bimetal disc 7. Switch device 41 is installed at a common terminal of the motor and, if the motor happens to be in an abnormal or overload state, an abnormal electric current flows to the common terminal, with a result that the bimetal generates heat (Joule's law), is heated and snaps open with the movable contacts 8 and 8 moving out of engagement with the stationary contacts 13*a* and 14*a*, thereby electrically deenergizing terminals 13*b* and 14*b*.

The interior of the switch device 41 is heated to a suitable temperature by means of a heater 15*a* so that the deformation or snapping of the bimetal disc 7 at the time of a fault condition may take place early. In the drawing, 15*b* is the terminal of the heater 15*a*. In this manner, the motor is maintained in an acceptable temperature range.

In a switch device 42 shown in plan view in FIG. 10 and in FIG. 11 which is a cross section taken along line 11—11 of FIG. 10, there is located a can 26 electrically isolated from a metal plate 22 via an insulation sheet 24. Metal plate 22 and the can are fixed mutually in such a manner that the lower portion 26*a* of the can 26 may clamp the metal plate 22 via an electrically insulative gasket 29. A stationary contact 23*a* is mounted on plate 22 and a terminal 23*b* is formed thereon. One end of the bimetal strip 27 is fixed to the inner wall of the can 26.

In the drawing, numeral 31 stands for a rivet head that mounts a bimetal strip 27 and its shank 31*a* is inserted through an aperture in the can 26 and welded to the can. As a result, the bimetal strip 27 is firmly fixed to the can 26. A heater 25*a* is wound on the peripheral surface of the can 26 and one terminal 25*c* of the heater 25*a* is connected with the can 26 by means of welding.

At the time when the motor is functioning normally, a movable contact 28 that is provided at the other end of the bimetal strip 27 is in contact with the stationary contact 23*a* and the terminal 23*b* and the terminal 25*b* of the heater 25*a* are electrically connected via the metal plate 22, stationary contact 23*a*, movable contact 28, bimetal strip 27, can 26 and the heater 25*a*.

The method for using the switch device 42 and the principle governing its action are the same as those of the switch device 41 described in FIG. 9.

In the case of a comparatively large-sized motor of more than one half HP, for example, the switch device 41 or 42 is electrically connected with the common terminal of the motor and is ordinarily used as shown in FIGS. 8*a* and 8*b*.

At the time when the motor is functioning normally, the contacts of the switch device are in engagement conducting the operating current. At the time when the motor load is excessive, however, the overload electric current is detected and the circuit is opened.

At the time when the motor experiences some trouble and the rotary element is locked, thereby causing an electric current which is several times as large as the normal operating current to flow, the switch device responds to the said abnormal electric current, with a result that the circuit is opened.

In the case of an overload state and a fault such as the locked state, etc., the switch device opens the electric circuit, thereby protecting the motor from being burnt. The temperature setting of the bimetal is so arranged that an automatic return of the switch device may be effected, with a result that the OFF/ON is repeated until the abnormal state is removed.

Since there is a limit to the life of the switch device, however, there are cases where the abnormal condition may not be removed indefinitely. In such a case, the switch may fail in the contacts closed position and the abnormal current will be passed continuously to the motor, with a result that the motor may be burnt or set on fire.

SUMMARY OF THE INVENTION

This device is invented in view of the aforementioned circumstances. It is an object of the invention that when the life of a switch device has come to an end and it has stopped functioning, the electric circuit is automatically opened in order to protect the electric appliance.

Briefly, in accordance with the invention, a switch device having a deformable member that deforms in response to variations in the temperature is used to control the movement of a movable contact into and out of engagement with a stationary contact that corresponds to this movable contact, characterized in that the aforementioned deformable member and a support member that supports this deformable member are mutually fixed by means of a meltable material, which melts at the time of an emergency, with a result that the aforementioned deformable member is dismounted, thereby effecting switching and opening of the circuit.

BRIEF DESCRIPTION OF THE DRAWINGS

FIG. 1 is a vertical cross section of a switch device.

FIG. 2 is a cross section taken along line 2—2 in FIG. 1.

FIG. 3 is a cross section of the bimetal disc and a bolt that supports the same before securing the disc to the bolt.

FIG. 4 is an equilibrium state of a tin-lead dual element alloy.

FIG. 5 is a vertical cross section of a switch device in an alternate embodiment.

FIG. 6 is a top plan view of a switch device according to still another embodiment.

FIG. 7 is a cross section taken along line 7—7 in FIG. 6.

FIG. 9 is a vertical section of a prior art switch device.

FIG. 10 is a plan view showing another prior art switch device.

FIG. 11 is a cross section taken along line 11—11 in FIG. 10.

DESCRIPTION OF THE PREFERRED EMBODIMENTS

Figure 1:
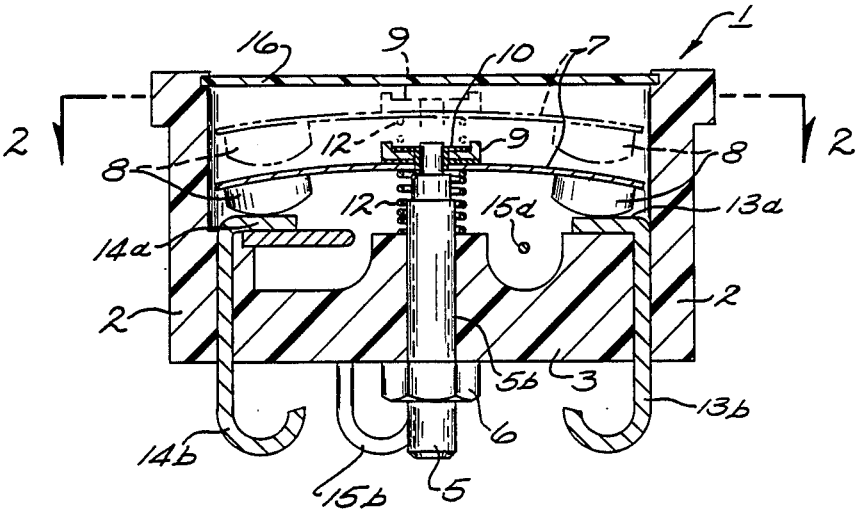
FIGS. 1 through 7 show several embodiments of this invention.
Figure 2:
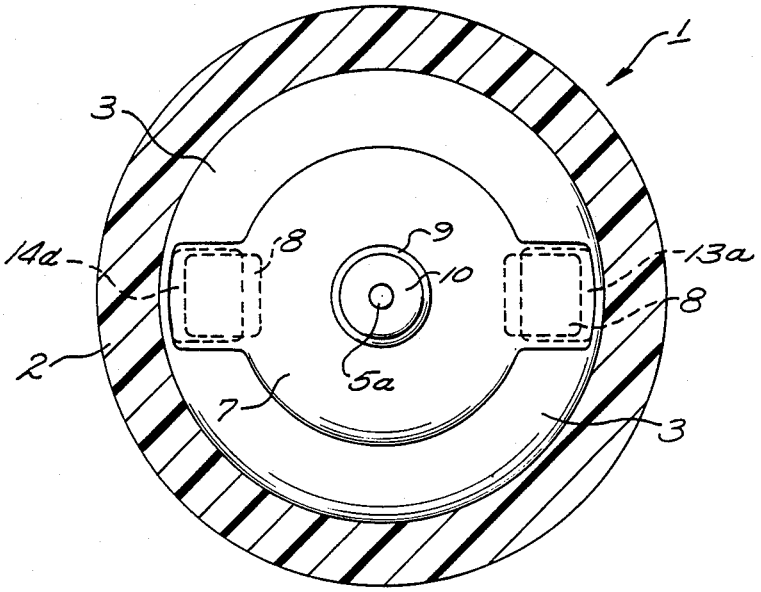
Figure 3:
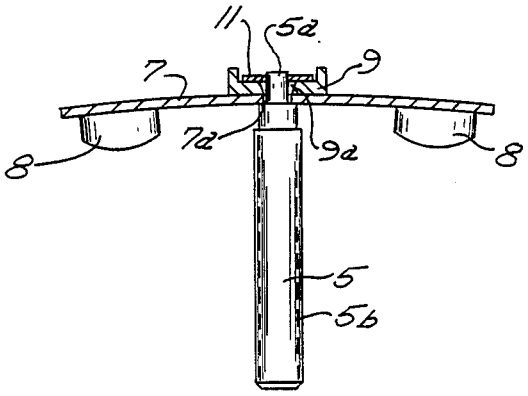
Figure 9:
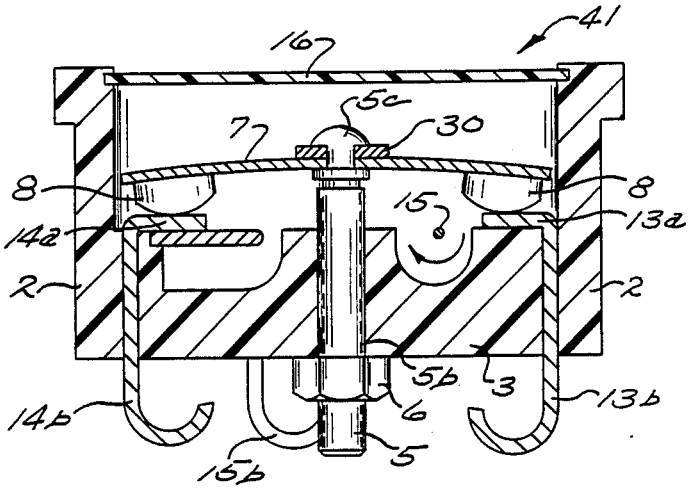
PRIOR ART Fig. 9.
FIGS. 9 through FIG. 11 show prior art examples.

Referring to FIGS. 1 through 3, switch devices are shown having structures which are similar to the prior art switch device as explained in FIG. 9. FIG. 1 shows a vertical cross section and FIG. 2 is a cross section taken along line 2—2 in FIG. 1. Those parts which are common with FIG. 9 have been designated by the same numerals as used in FIG. 9.

Since the principle governing the action of the switch device 1 is the same as described for the switch device in FIG. 9 shown above, the explanation will not be repeated.

The electrically insulative housing 2 is cylindrical in shape and the bottom wall 3 is formed integrally with the housing 2. The bimetal is a bimetal disc 7 which is in the shape of a disc, with the movable contacts 8 and 8 being mounted on the extensions at corresponding locations of the disc.

This switch device 1 carries out the same action as explained with relation to FIG. 9. What should be noted in this example is the fact that, at the tip of a bolt 5, there is provided a protrusion 5*a* having a small diameter. The protrusion 5*a* is inserted through an aperture 7*a* at the center of the bimetal disc 7 as well as through an aperture in a fixed plate 9 located on the bimetal disc 7. Bolt protrusion 5*a*, bimetal disc 7 and the fixed plate 9 are soldered and secured by means of solder 10.

In addition, there is provided a coil spring 12 between the bimetal disc 7 and the bottom wall 3 and the bimetal disc 7 is given an upward bias as shown in the figure by means of coil spring 12.

Figure 8A:
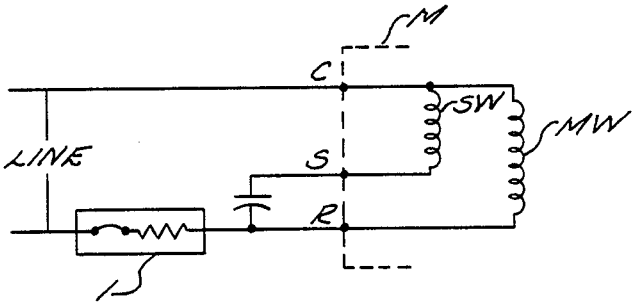
FIGS. 8*a* and 8*b* are circuit diagrams showing the connection between the switch device and the motor windings.
Figure 8B:
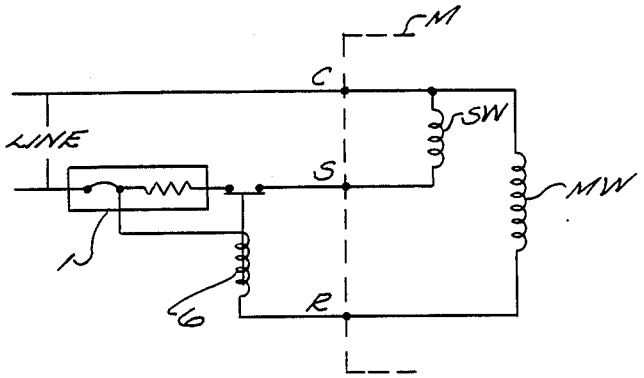

FIGS. 8*a* and 8*b* are sketches showing an example of the installation of the switch device 1 for a motor.

Motor M comprises start winding SW and main winding MW connected between a line current source. Switch 1 can, for example, be used in conjunction with a starting relay as shown in FIG. 8*b* with the coil 6 of the relay coupled to switch 1 intermediate the disc and heater. FIG. 8*a* shows another example with switch 1 connected directly to the main winding terminal and to a capacitor coupled between the main and start windings.

If the operation of the motor becomes abnormal and the temperature of the motor windings rises or if an excessive electric current flows to the switch device, the ON and OFF state of the switch device 1 are repeated as described earlier, thereby repeating the deformation and release of the bimetal disc 7. Because of this repetition, the bimetal disc 7 comes to lose normal deformation capability due to fatigue and, if the movable contacts 8 and 8 remain in engagement with the stationary contacts 13*a* and 14*a* during an overload or if the contacts melt, the bimetal disc 7 is heated to a temperature which is higher than the temperature at which the normal deformation takes place.

At this point, the solder 10 melts, with a result that the fixing of the bimetal disc 7 to the bolt 5 is released and, as is shown by the phantom lines in FIG. 1, the bimetal disc 7 is dismounted and separated from the bolt 5 along with the fixed plate 9 and is raised therefrom. The movable contacts 8 and 8 are moved out of engagement with the stationary contacts 13*a* and 14*a*, with a result that the switch device 1 is brought into an OFF state.

The melting of the solder 10 is carried out by the heat conducted from the bimetal disc 7 and/or Joule's law heat that is generated in the solder 10. By setting the melting temperature of the solder 10 slightly higher than the temperature of the bimetal disc 7 at the OFF time, the switch device will be brought into an OFF state quickly at the time when the aforementioned emergency state takes place. In this manner, the motor will not be damaged and will be reliably protected.

The temperature at which the bimetal disc 7 snaps and the movable contacts 8 and 8 become separated from the stationary contacts 13*a* and 14*a* is selected by the design of the bimetal disc 7. In addition, the temperature at which the solder 10 melts is determined by the composition of the solder.

Figure 4:
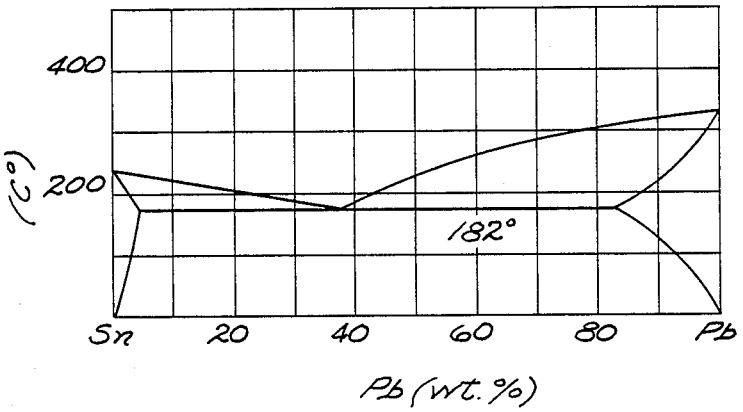

FIG. 4 shows the equilibrium state of the solder or the tin-lead dual element alloy. The temperature at which the solder melts is determined by the lead content of the solder. In the event that the melting is to be carried out at a temperature which is lower than the eutectic temperature of 182 degrees centigrade, a suitable amount of cadmium, for example, can be included to obtain melting in conformity with the temperature.

It is mentioned in this connection that the aforementioned melting temperature does not mean the temperature at which the production of the liquid phase begins or the temperature at which the solid phase starts disappearing but the temperature at which the solder melts and loses the aforementioned fixing capability for practical purposes.

The fixing of the bimetal disc 7 to the bolt 5 is carried out as shown in FIG. 3. The protrusion 5*a* and the small diameter of the bolt 5 is inserted through aperture 7*a* of the bimetal disc 7 and the protrusion 5*a* is further inserted into a through hole 9*a* of the fixed plate 9 which is in the shape of a dish. Next, the solder 11 in the shape of a flat washer is placed on the fixed plate 9 and the solder 11 is melted by heating same, the molten solder enters between the protrusion 5*a* and the fixed plate 9 and bimetal disc 7 and, when the solder solidifies by subsequent cooling, the bolt 5, bimetal disc 7 and fixed plate 9 are mutually firmly secured as shown in FIG. 1.

Figure 5:
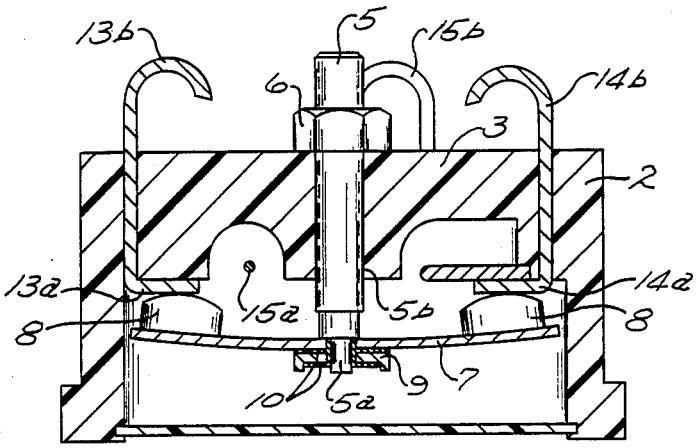

It will be noted in this connection that the coil spring 12 shown in FIG. 1 can be omitted. If the vertical orientation of the switch device in FIG. 1 is reversed as shown in FIG. 5, the bimetal disc 7 will become separated through its own weight together with the fixed plate 9 from the bolt 5. Plate 9 and disc 7 will fall when the solder melts with the movable contacts 8 and 8 separating themselves from the stationary contact 13*a* and 14*a*, with a result that this switch device is brought into an OFF state.

In this switch device, the coil spring is not required thereby lowering the manufacturing cost.

Figure 6:
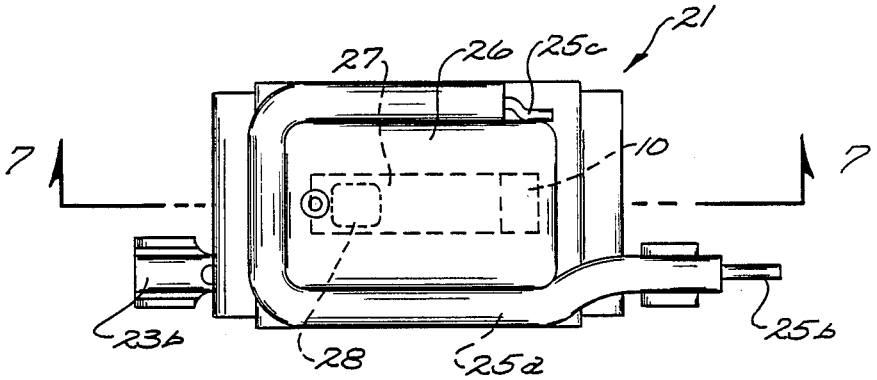
Figure 7:
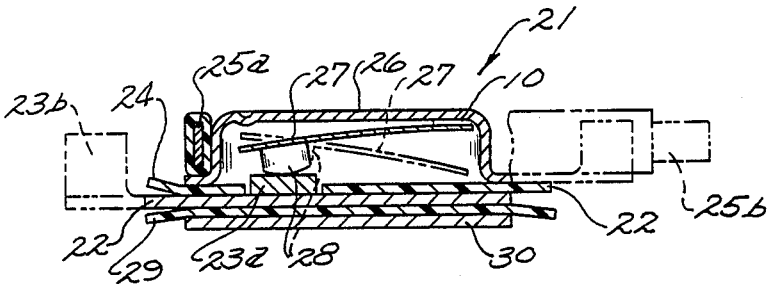
Figure 10:
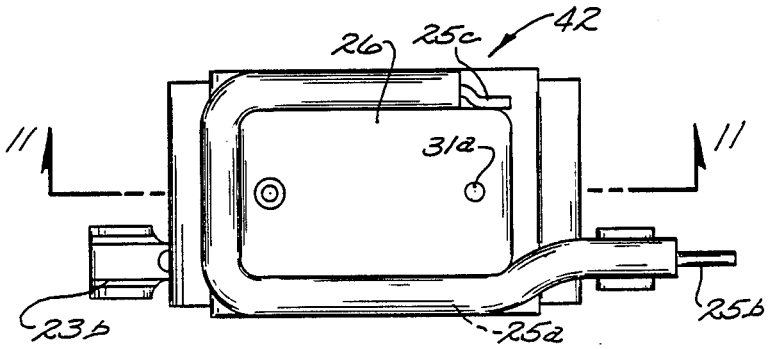
PRIOR ART Fig. 10.
Figure 11:
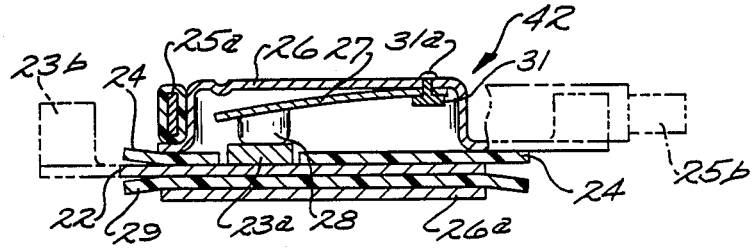
PRIOR ART Fig. 11.

FIGS. 6 and 7 show switch devices having structures which are similar to those of the switch devices explained in FIGS. 10 and 11. FIG. 6 is a top plan view and FIG. 7 is a cross section taken along line 7—7 in FIG. 6. The parts which are common to FIGS. 10 and 11 are indicated by the same numerals.

Moreover, the structure and action of this switch device 21 have been explained in FIGS. 10 and 11 except for what is described below and, accordingly, any explanation of these will be omitted here.

As is shown in FIG. 6, a terminal side of the bimetal strip 27 is soldered and fixed to the inner surface of the can 26 by means of a solder 10.

When the bimetal strip 27 finally fatigues by the repetition of the deformation and the release of deformation, thereby losing its normal deformation capability, the bimetal 27 is not deformed even in the case where operation of such an electric apparatus as the motor may be abnormal and the movable contact 28 and the stationary contact 23*a* remain in the state of engagement. In this state, the bimetal strip 27 continues to increase in temperature and the solder 10 melts. As is shown by a phantom line in FIG. 7, the bimetal strip 27 becomes separated from the can 26 and drops.

Because of the above, the terminals 23*b* and 25*b* are electrically deenergized and the switch device 21 is brought into an OFF state, with a result that such an electric apparatus as the motor is not damaged but is accurately protected.

Materials used to secure the bimetals 7 and 27 to the support members that support same (such as the bolt 5 and can 26) can use electrically conductive or insulative thermoplastic adhesive materials in addition to the solders.

Various modifications can be made in addition to what has been described above on the basis of the technical concept of this invention. For example, the bimetal can have any suitable shape and the movable contact can be located at any suitable location in conformity with the structure and the shape of the switch device. In addition, some other members that deform in conformity with the variations in temperature can be used in the place of the bimetal.

As has been explained above, this invention is so constructed that a deformation member that is deformed in conformity with variations in temperature is fixed to a support member by means of a meltable material that melts at the time of an emergency, the aforementioned deformation member is displaced by the aforementioned melting and the switching is thereby carried out, with a result that switching can be effected reliably (such as the opening of the electric circuit, etc.) even in the case of an emergency such as the loss of the normal deformation ability due to the fatigue of the aforementioned deformation member, for instance, or even when the melting of the contact points may take place.

Accordingly, the supply of electricity to the electric apparatus is automatically terminated at the time of the aforementioned advent of an abnormal state, thereby effectively protecting the electric apparatus from being damaged and accurately protecting the same.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed:

1. A switch device comprising a deformable member that deforms in response to variations in its temperature used to control the position of a movable contact which is movable into and out of engagement with a stationary contact, the deformable member being a snap acting disc mounting thereon the movable contact, an aperture formed through the disc and a support member including a protrusion which extends from the bottom of the disc up through the aperture supporting the deformation member, a plate having an aperture extending therethrough being received on top of the disc with the protrusion extending through the aperture in the plate, the deformation member and the support member being mutually fixed by means of a meltable material with the meltable material engaging the protrusion and the plate to lock the disc to the support, the meltable material melting at the time of an emergency, with the deformable member becoming separated from its support to thereby open an electrical circuit.

2. A switch device according to claim 1 wherein the meltable material is a tin-lead solder.

3. A switch device according to claim 2 further including a spring disposed between the support and the disc adapted to place a bias on the disc in a direction away from the support.

4. A switch device comprising a housing mounting therein at least one movable contact movable into and out of engagement with a corresponding stationary contact, a thermostatic member movable in response to variations in temperature operatively connected to the movable contact to control the position of the movable contact, the member selected to move the movable contact out of engagement with the stationary contact at a first selected temperature, and the thermostatic member mounted on a support, the thermostatic member being a snap acting disc mounting thereon the movable contact, an aperture being formed through the disc and the support including a protrusion which extends from the bottom of the disc up through the aperture, the device further including a plate having an aperture extending therethrough being received on top of the disc with the protrusion extending through the aperture in the plate and solder material selected to melt at a second selected temperature higher than the first selected temperature engaging the protrusion and the plate to lock the disc to the support.

5. A switch device according to claim 4 wherein the deformable member is a thermostatic strip having first and second ends, the movable contact being mounted at the first end and the solder material securing the second end to a support.

6. A switch device according to claim 4 wherein the solder material is a tin-lead solder.

* * * * *